US008425072B2

(12) United States Patent
Hurwitz

(10) Patent No.: US 8,425,072 B2
(45) Date of Patent: Apr. 23, 2013

(54) INTERCHANGEABLE ATTACHMENTS FOR ACCESSORIES

(75) Inventor: Marni Markell Hurwitz, Far Hills, NJ (US)

(73) Assignee: I Did It, Inc, Far Hills, NJ (US)

( * ) Notice: Subject to any disclaimer, the term of this patent is extended or adjusted under 35 U.S.C. 154(b) by 690 days.

(21) Appl. No.: 12/590,156

(22) Filed: Nov. 3, 2009

(65) Prior Publication Data

US 2010/0277944 A1 Nov. 4, 2010

Related U.S. Application Data

(63) Continuation-in-part of application No. 12/460,705, filed on Jul. 23, 2009, now Pat. No. 8,142, 053.

(60) Provisional application No. 61/215,370, filed on May 4, 2009.

(51) Int. Cl.
*F21V 21/084* (2006.01)

(52) U.S. Cl.
USPC ..... 362/103; 362/555; 362/105

(58) Field of Classification Search ..... 362/103, 362/104, 106, 555, 105
See application file for complete search history.

(56) References Cited

U.S. PATENT DOCUMENTS

| | | | | |
|---|---|---|---|---|
| 3,871,336 A | | 3/1975 | Bergman | 119/106 |
| 3,999,521 A | | 12/1976 | Puiello | 359/518 |
| 4,167,156 A | | 9/1979 | Kupperman | 119/795 |
| 4,173,201 A | | 11/1979 | Chao | 119/859 |
| 4,263,951 A | | 4/1981 | Siegel | 150/111 |
| 4,425,600 A | * | 1/1984 | Barnhart | 362/84 |
| 4,513,692 A | | 4/1985 | Kuhnsman | 119/797 |
| 4,887,552 A | | 12/1989 | Hayden | 119/793 |
| 4,895,110 A | | 1/1990 | LoCascio | 119/859 |
| 5,046,456 A | | 9/1991 | Heyman | 119/859 |
| 5,140,946 A | | 8/1992 | Pennock | 119/859 |
| 5,363,809 A | | 11/1994 | Roe | 119/792 |
| 5,370,082 A | | 12/1994 | Wade | 119/859 |
| 5,429,075 A | | 7/1995 | Passarella | 119/795 |
| 5,523,927 A | | 6/1996 | Gokey | 362/103 |
| 5,535,106 A | * | 7/1996 | Tangen | 362/108 |
| 5,558,044 A | | 9/1996 | Nasser, Jr. | 119/796 |
| 5,630,382 A | | 5/1997 | Barbera | 199/859 |
| 5,762,029 A | | 6/1998 | DuBois | 119/796 |
| 5,774,892 A | | 7/1998 | Tisdale et al. | 2/69 |
| 5,803,266 A | | 9/1998 | Blackwelder | 206/575 |
| 5,850,807 A | | 12/1998 | Keeler | 119/799 |
| 5,967,095 A | | 10/1999 | Greves | 119/795 |
| 6,170,968 B1 | | 1/2001 | Caswell | 362/469 |

(Continued)

*Primary Examiner* — David V Bruce
(74) *Attorney, Agent, or Firm* — Ernest D. Buff; Ernest D. Buff & Assoc. LLC; Margaret A. La Croix

(57) ABSTRACT

An interchangeable attachment for an article (such as a head band, hand bag or pocketbook) capable of modifying the look and feel of said article. The article comprises a proximal end, distal end and a central section and is capable of receiving said interchangeable attachment. The interchangeable attachment includes a top wall having a show surface and a back wall having a securing member adapted to engage with the article for removably attaching the interchangeable attachment to the article. The interchangeable attachments have a plethora of designs and may include LED, fiber optic and/or reflective properties. Advantageously, the interchangeable attachments provide aesthetic appeal and allow the ability to design one's own accessory. They also afford enhanced visibility and/or increased safety during dusk or nighttime hours.

25 Claims, 15 Drawing Sheets

U.S. PATENT DOCUMENTS

| | | | | |
|---|---|---|---|---|
| 6,189,542 | B1 | 2/2001 | Shepard | 132/237 |
| 6,209,351 | B1 | 4/2001 | Zeleny | 63/1.16 |
| 6,289,849 | B1 | 9/2001 | Macedo | 119/796 |
| 6,557,498 | B1 | 5/2003 | Smierciak | 119/858 |
| 6,688,316 | B1 * | 2/2004 | Klug | 132/286 |
| 6,971,424 | B1 | 12/2005 | Angevine | 150/104 |
| 7,350,342 | B2 | 4/2008 | Owens | 54/12 |
| 7,421,980 | B1 * | 9/2008 | Ehlers | 119/858 |
| 8,142,053 | B2 * | 3/2012 | Hurwitz | 362/249.16 |
| 2009/0044430 | A1 | 2/2009 | Philpott | 36/136 |
| 2009/0100714 | A1 | 4/2009 | Coger | 36/100 |
| 2009/0130954 | A1 | 5/2009 | Maricevic et al. | 450/88 |

* cited by examiner

INTERCHANGEABLE ATTACHMENTS FOR ACCESSORIES

CROSS-REFERENCE TO RELATED APPLICATIONS

This is a Continuation-In-Part of application Ser. No. 12/460,705, filed Jul. 23, 2009 now U.S. Pat. No. 8,142,053, for "Interchangeable Attachments For Collars, Leashes, Belts And Accessories" which, in turn, claims the benefit of Provisional Application No. 61/215,370, filed May 4, 2009, the disclosures of which are hereby incorporated in their entirety by reference thereto.

BACKGROUND OF THE INVENTION

1. Field of the Invention

The present invention relates to interchangeable attachments for accessories; and more particularly, to interchangeable attachments for hair accessories including head bands, barrettes, and accessories such as hand bags and clutches, belts, and caps, having various designs, jeweled portions, LED illumination and/or reflective properties, and which are readily removably attached to a portion of an accessory such as a head band or other hair accessory, hand bag accessory, belt, and/or strap, to provide aesthetic appeal and versatility and/or to enhance visibility of the items with which they are associated, thereby providing interchangeability of style and/or increasing user safety while walking in the vicinity of land vehicles during dusk or nighttime hours.

2. Description of the Prior Art

There exist certain occasions where one may wish to personalize accessory articles to suit individual style and taste. On other occasions one may desire to match or complement an outfit with accessory articles. Personalization of accessory articles presently requires the purchase of a plethora of accessory items having a variety of different colors and designs. Accumulation of the required accessory items is expensive and overcrowds closets. Changing one's look from daytime to evening oftentimes requires toting a myriad of different articles for changing. Frequently a woman desires to change-up her purse from a day bag to an evening bag, which not only necessitates carrying a separate evening bag, but additionally requires the switching-out of items from the day-bag to the evening bag, and vice versa when use of the day-bag is desired. Such switching processes are cumbersome, and can become overly obvious and awkward if others are present. Additionally, there are occasions such as when walking during dusk or nighttime hours, when safety precautions should be taken. Such activity can be hazardous in neighborhoods where automobiles are encountered. Illuminating characteristics of the automobile headlamps, generally afford an illumination range of approximately 25 to 50 feet. This illumination range can be significantly reduced by mist or fog, or bends in the road. Despite improvements to vehicle headlights, pedestrians are oftentimes not recognized by automobile drivers until the distance between the automobile and the pedestrian or pet is small. Children are particularly vulnerable to this danger when walking home from school or about the neighborhood, or playing near a busy thoroughfare.

Various decorative interchangeable accessories have been provided for hair and jewelry, however those heretofore known and utilized fail to provide an interchangeable article having an exterior surface adapted to receive an interchangeable attachment without having to manipulate the body of the article. For example: U.S. Pat. No. 6,688,316 to Klug discloses a decorative hair accessory kit with interchangeable decorations and a storage board. The kit includes a hair band, hair comb, barrette and a plurality of interchangeable decorations, including a storage board for the components. Hook and loop fastening material is adhesively attached to the display surface of the hair controlling device as well as the underneath surface of the decoration. Decorations are interchangeably attached to a hair band, barrette, and hair comb by means of the hook and loop fastening material. The accessory kit structure does not suggest a headband having a cover sheaf that receives an elongated interchangeable attachment adapted to cover substantially the entire show surface of the headband; U.S. Pat. No. 6,209,351 to Zeleny discloses an interchangeable jewelry accessory for accessorizing a setting-mounted gemstone. The accessory includes an ornament support base having an ornament support section and a setting-engaging clip section, which projects from the ornament support section. The ornament support section includes an ornament mount having at least one ornament mounted thereon. The interchangeable jewelry accessory does not provide for articles other than jewelry, and does not disclose or teach bags, purses, caps, hats, backpacks, clothing, and/or belts having a central section appointed to receive interchangeable attachments; and U.S. Pat. No. 6,189,542 to Shepard discloses an improved hair clip employing a pair of cooperating main members that are pivotally connected and biased into a hair engaging orientation. A mirror is removably attached to the first end of the first main member, and a cosmetics case is removably attached to the first end of the second main member. Attachment sleeves are removably attached to the main member middle portions. Each storage sleeve may be capped for storage of loose items or may accept one of several interchangeable accessory tubes. The hair clip is not structurally provided with interchangeable attachments that simply attach to the top or front fact of an article. Rather, interchangeable accessory tubes are used to change the look of the hair clip.

Other interchangeable accessories have been provided for clothing and shoes. U.S. Pat. No. 5,803,266 to Blackwelder discloses an accessories kit for allowing a user to coordinate a clothing accessory with a variety of outfits. The kit includes a clothing accessory and a plurality of decorative, interchangeable ornaments for securing the attachment to the exterior surface of the clothing accessory by a VELCRO™ fastener; U.S. Pat. No. 5,774,892 to Tisdale, et al. discloses clothing, specifically trousers and a shirt, which may be converted to shorts or a short sleeve shirt, respectively, using removably attached lower leg and lower sleeve portions. A plurality of interchangeable accessory pocket components are further provided which may be removably attached to the upper sleeve and leg portions allowing accessory items to be carried thereon regardless of which version of the pants or shirt is being used; U.S. Patent App. Pub. No. 20090130954 to Maricevic et al. discloses a decorative bra strap design having an interchangeable bra strap/jewelry accessory. A semi-stretchable design based on a non-stretchable beading core is attached at one or both ends to a stretchable elastic section, which terminates in a jewelry-clasp type ending. The jewelry-clasp ending serves to attach to any kind of bras having interchangeable bra straps, or to a "strapless" bra with hook loops; U.S. Patent App. Pub. No. 20090100714 to Coger discloses a footwear accessory system including a shoe having an exterior surface. The latter is appointed to receive an interchangeable article, including a contour that matches a contour of the exterior surface of the shoe; U.S. Patent App. Pub. No. 20090044430 to Philpott discloses a shoe wherein a user can change the color and/or style of a logo/trademark. Each shoe is equipped with a female receptacle which will engage with a predetermined male post locking the logo/trademark into place. These devices fail to provide an interchangeable accessory wherein an interchangeable attachment is removably secured to a central portion of the article.

Interchangeable accessories concerning handbags have been provided, however these devices require a significant portion of the handbag to be interchanged. This, in turn, requires the user to lug around large pieces that are interchangeable. For example: U.S. Pat. No. 6,971,424 to Angevine discloses an interchangeable handbag having a frame and an insert. The frame comprises a substantially rigid bottom panel, connected to a front section, a back section and two side sections. At least one insert, removably connected to the frame, has an openable top section to receive the contents of the handbag; U.S. Pat. No. 4,263,951 to Siegel discloses an interchangeable accessory system for organizer handbags. Multiple handbags have interchangeable components and accessories. A wallet, cosmetic case, key ring, address and note books and selected components are provided with attachment means that permit interchangeable accessories to be transferred from one handbag to another. Miche® Bag, found at http://www.michebag.com/pages/how-to discloses a bag base having front, bottom, and back walls appointed to receive a shell equipped with a magnetic attachment means. The attachment fully encompasses and covers the front, bottom, and back walls of the bag base to produce a different look for the bag. These disclosed hand bags require substantially the entire show surface of the bag to be interchangeable. As a result the user must carry a large interchangeable accessory which, in turn, can be cumbersome. In particular, these interchangeable bag structures are constructed so that the bag base and overlay are rigidly designed. The shell coverings are designed to cover substantially the entire show surface (i.e. all three sides of the bag base) and do not function as small overlays. Due to their substantial size and structure, the shells must be perfectly aligned with the existing frame. Such shell coverings completely change the exterior of the bag—refacing it on all three sides, rather than changing a fraction of the bag's show surface. These large obtuse shells are much too large to be carried within the bag itself. Moreover, their size prevents discrete modifications to the "look" of the bag by simply placing an overlay over a small section of the bag.

Modifications that enhance the aesthetic value of articles such as handbags, belts, caps, leashes, collars and the like have also been used to address safety issues. Several approaches devised by prior art workers attempt to provide solutions for safety concerns involving pedestrians and pets. These approaches include use of pet collars and leashes that are illuminated or reflective. None of these approaches suggests indicating the whereabouts of a pedestrian or providing interchangeability so that a safety feature such as an LED, electroluminescent lamp, fiber optics or material having reflective properties can be incorporated with an article at a specific time of the day to enhance visibility during dimly lit conditions. None of these approaches provides such safety features as decorative, reflective appliqués that removably attach to garments and accessories such as backpacks, hair bands, hats, purses, luggage, or the like.

Illuminated dog collars using LED's or other powered illumination means are known in the art. These power-illuminated leashes require batteries, light bulbs or other lighting elements, and are not provided as decorative, removable attachments. For examples, see: U.S. Pat. Nos. 4,173,201; 4,513,692; 4,895,110; 4,887,552; 5,046,456; 5,140,946; 5,370,082; 5,429,075; 5,523,927; 5,535,106; 5,558,044; 5,630,382; 5,762,029; 5,850,807; 5,967,095; 6,170,968; 6,289,849; and 6,557,498. None of these power-illuminated leashes provides decorative, removable LED attachments and/or decorative reflective attachments. Dog collars, harnesses and leashes which include reflection capabilities are known in the art, but do not provide decorative features that include reflective properties. For examples, see: U.S. Pat. Nos. 3,871,336; 3,999,521; and 4,167,156.

In addition to design elements and safety concerns, many individuals and children wish to create individualized accessories. Interchangeable attachments that temporarily alter the appearance of accessories such as belts, bags and backpacks, have not heretofore been proposed. Rather, the previously proposed designs to decorate such items require permanent application to the accessory. Further, many pet owners like to decorate their pets with jeweled collars and the like. Existing collars of this type include attachment mechanisms that limit personalization by the pet owner.

Some decorative devices for leashes have been provided, however these decorative devices do not have a plurality of decorative removable attachments. Accordingly, they do permit an individual to readily alter the decorative effect when such alteration or personalization of the decorative device is desired. For examples, see: U.S. Pat. Nos. 5,363,809; 7,350,342; and 7,421,980.

Notwithstanding the efforts of prior art workers to construct decorative belts, purses, handbags, hair accessories, baseball caps and/or accessories, there is a need in the art for interchangeable attachments that are removably secured in a manner which facilitates transformation of the article's exterior. Additionally, there is a need in the art for interchangeable attachments having a variety of design created by the introduction of LED's and/or reflective properties that are temporarily secured to a portion of a belt, purse, handbag, hair band, baseball cap and/or accessory, and which provide aesthetic appeal and enhanced visibility.

SUMMARY OF THE INVENTION

The present invention provides interchangeable attachments that can be removably secured to head bands and barrettes, hand bags and clutches, belts, and caps, collars and leashes. The interchangeability of these accessory articles enables an individual to readily change the look and feel of the article. Hair accessories such as head bands and barrettes, hand bags and clutches, belts, and caps, having various designs, jeweled portions, LED's and/or reflective properties, can be readily attached to or removed from a portion of the article to provide an article with more aesthetic appeal, versatility and enhanced visibility. A plethora of designs are provided on a show surface of an interchangeable attachment. The interchangeable attachment facilitates design variance. One or more LED's, fiber optics, electroluminescent lamp and/or material exhibiting reflective properties can be integrated therein. With this construction, the attachments are especially well suited be removably attached to alter the appearance of an accessory such as a head band, barrette, hand bag, clutch, belt, suspenders, cap, collars and leashes, and the like, to provide aesthetic appeal and increased safety during dusk or nighttime hours. The show surface of the interchangeable attachments may have a textured appearance, such as smooth, silky, rough, leather, metallic or jeweled. In one embodiment the interchangeable attachments are presented as hook and loop fasteners or adhesive. In another embodiment the interchangeable attachments are provided as shaped attachment forms that removably adhere to a central section of a head band, barrette, hand bag, clutch, belt, cap, collar or leash providing an interchangeable exterior surface that ultimately changes the look of the article. In another embodiment the interchangeable attachments are provided as patches or swatches. In addition, the interchangeable portions may be provided as a kit wherein pluralities of interchangeable portions are provided to facilitate individualized styling.

This invention pertains to attachments for accessories, such as bags and back packs, and hair accessories, such as head bands or barrettes, that can be individualized by a person and offer high visibility at dusk, and in other dimly lit environments. In one embodiment, an attachment having an LED can be secured to the article to improve visibility during daytime and nighttime excursions with the pet. Applications are appointed for use on head bands and barrettes, hand bags, clutches, purses, back packs, clothing having straps, belts, decorative pillows, seat covers and baseball caps.

In an alternative embodiment, a plurality of holes are integrated in a leash or collar central section, or a central section of a strap of a bag or a portion of a belt, that are appointed to receive a decorative attachment. The decorative attachments comprise a plethora of designs and may include at least one LED integrated therein, and/or reflective properties. Attachments may be created to accept the LED or any kind of Optics that are used for fun and to create a more visible pet or person. The attachments provided as LED buttons, optics, gems, or charms are to be inserted into the designed holes to create a more individual piece, while providing enhanced safety through increased visibility. Enhanced safety is not only afforded, but the attachments allow versatility and freedom of choice to design a creation based on individual preference. Shapes, sizes and designs presented by the plethora of attachments are all different. Selection of the attachments as well as arrangement on the leash, collar or accessory can be uniquely determined in situ. Preferably, the attachments are presented as snap on buttons and are sold in a package containing at least one attachment, and preferably more than one. The snap on attachments have a back piece that lays flat once it is inserted through the hole, or may have a ball-like end that inserts and remains secure when in place, so the back portion of the attachment or LED or optic button/charm piece may vary in design. Alternatively, the attachment may be an independent piece retrofitted with a clip-like backing that holds it in place against the strap. The LED's and the optic light are used with a small watch battery, and last a long time, so battery life does not become a concern.

In one embodiment, the attachment is provided as an interchangeable elongated central section overlay which is appointed to be removably received over the central section of an article, such as a belt or strap on clothing, a purse strap and/or a central portion of a purse or clutch. Preferably, mating hook and loop fastener portions (such as those sold under the trademark VELCRO) are provided on the elongated central overlay attachment and central section of the article. Preferably, the elongated attachments are sold with the article (belt, strap on clothing, purse strap and/or central portion of a purse or clutch, or backpack) to offer an alternative design. The interchangeable attachments may be sold separately from the article, and/or may be sold as a kit with a plurality of interchangeable attachments. In operation, the user simply presses the interchangeable attachment to removably affix it the central section of the body of the belt, strap on clothing, purse strap and/or central portion of a purse or clutch, and a new look or design is created. For removal, the user simply peels the interchangeable attachment from the central section of the body of the belt, strap on clothing, purse strap and/or central portion of a purse or clutch or backpack. Reflective material or LED or fiber optics may be integrated within the interchangeable attachment for extra visibility when wearing. The interchangeable attachments can be used on bag or backpack straps and/or belts, particularly for children, straps on clothing, purse straps and/or central portions of a purse or clutch. In another embodiment the interchangeable attachments are comprised of a patch, swatch or appliqué, and/or a plurality of patches, swatches, or appliqués. A kit may be provided including interchangeable pieces, such as appliqués, swatches, patches. Designs and shapes of these pieces can be made to vary on at least a portion, and preferably substantially the entire show surface of the attachment strips.

The article has at least one region comprising a proximal end, distal end and a central section having at least one connection means appointed to receive an interchangeable attachment. The interchangeable attachment includes a top wall having a show surface and a back wall having a securing member adapted to engage with the connection means of the article for removably attaching the interchangeable attachment to the article. In one embodiment secondary interchangeable attachments are provided as button-type attachments. In another, the interchangeable attachment is provided as an elongated attachment portion appointed to substantially cover the central section of the elongated region of the article. The interchangeable attachments have a plethora of designs and may include at least one LED, fiber optic and/or reflective properties to provide both aesthetic appeal and enhanced safety during dimly lit conditions, such as those extant at dusk or nighttime hours.

In a broad embodiment, an interchangeable attachment for an article, is provided comprising a top wall having a show surface, side walls, and a back wall having a securing member adapted to secure the interchangeable attachment to the article. The interchangeable attachment may be an elongated interchangeable attachment portion and/or an interchangeable appliqué, patch or swatch, or combinations thereof. The article is preferably a headband, hair barrette, belt, handbag, purse, clutch, clothing with straps, backpack, suspenders, jeans, travel bags, animal carriers or a baseball cap.

A process for manufacture of an interchangeable attachment for an article is also provided. The process includes the steps of (i) forming the article having at least one region comprising a proximal end, distal end and a central section, (ii) forming at least one connection means within the central section of the elongated region of the article, the connection means being adapted to receive the interchangeable attachment, and (iii) forming the interchangeable attachment comprising a top wall having a show surface, side walls, and a back wall having a securing member adapted to engage with the connection means of the central section of the article for removably attaching the interchangeable attachment to the region of the article.

Interchangeable attachments temporarily alter the article's appearance providing safety to the user when LED, optics, or reflective properties are included. In operation, the interchangeable attachments are simply added-on to the article by engaging the connection means of the region of the article with the securing member of the interchangeable attachments. When desired, the interchangeable attachment is simply removed from the article to once again change the look and, optionally, feel thereof.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE INVENTION

Figure 1A:
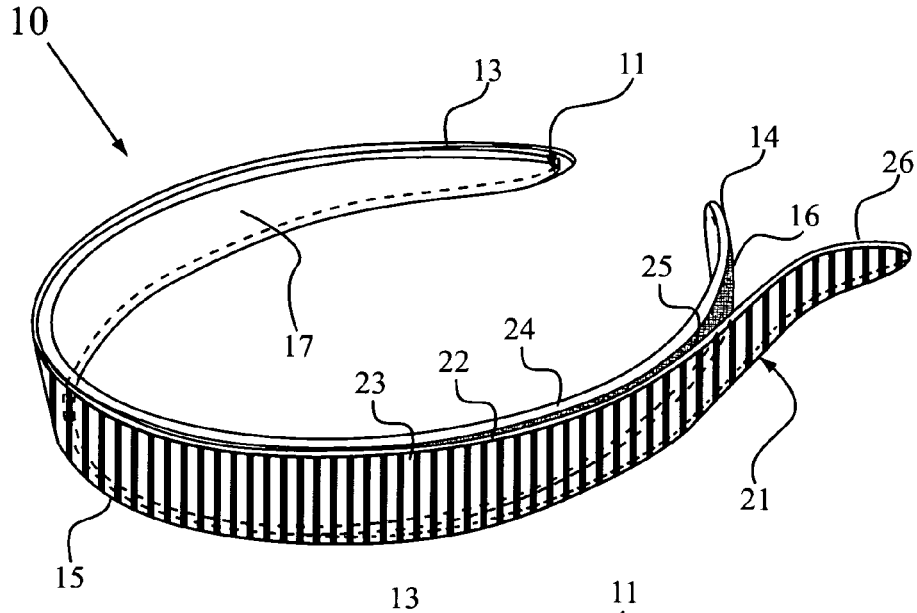
FIG. 1*a* is a schematic view of an embodiment of the interchangeable attachment for an article, wherein the article is provided as a head band and the interchangeable attachment is substantially covering the head band.

The present invention provides interchangeable attachments for an article, including head bands and barrettes, hand bags and clutches, belts, clothing articles and/or caps. The article has at least one region comprising a proximal end, distal end and a central section having at least one connection means appointed to receive an interchangeable attachment. The interchangeable attachment includes a top wall having a show surface and a back wall having a securing member adapted to engage with the connection means of the article for removably attaching the interchangeable attachment to the article. In one embodiment secondary interchangeable attachments are provided as button-type attachments. In another, the interchangeable attachment is provided as an elongated attachment portion appointed to substantially cover the central section of the elongated region of the article. In yet another embodiment, the interchangeable attachments are provided as appliqués, patches or swatches, designs or shapes. The interchangeable attachments have a plethora of designs and may include LED, fiber optic and/or reflective properties to provide both aesthetic appeal and enhance safety during dimly lit conditions such as those extant at dusk or at night.

The interchangeable attachments for hair accessories, including head bands, barrettes, and/or accessories including hand bags and clutches, and/or belts, comprise various designs, jeweled portions, LED and/or reflective properties. Such interchangeable attachments are readily removably attached to a portion of an accessory to provide aesthetic appeal and versatility. In addition, they can be removably attached as aforesaid to enhance visibility of the items with which they are associated. Changing a day bag, to an evening bag (clutch) with just a "swap" of an overlay is afforded by the interchangeable attachments. Pieces or the interchangeable attachments are constructed with mating fastening mechanisms, including for example hook and loop fasteners such as are sold under the trade name VELCRO. These mating fasteners are integrated onto both the bag as well as the pieces designed to be overlaid onto the item. Positioning of the interchangeable attachment/overlay piece is readily carried out. Incorporating hook and loop material into the interchangeable accessory components not only facilitates the removable attachment process; it also provides indication of the exact positioning of the attachment/overlay (appliqué).

The interchangeable attachment for an article is constructed so that the article has a proximal end, distal end and a central section. The central section of the article has at least one connection means appointed to receive the interchangeable attachment. The interchangeable attachment comprises a top wall having a show surface, side walls, and a back wall having a securing member adapted to engage with the connection means of the central section of the article for removably attaching the interchangeable attachment to the article. In its preferable embodiments, the article may be constructed as a hand bag, purse, backpack or clutch. Materials for the article/bag as well as for the interchangeable attachments or interchangeable appliqué/overlay pieces may vary in design and texture. In other embodiments, the article is constructed as a belt, hair accessory such as head band or barrette, luggage, or clothing with interchangeable strap portions. Preferably, hook and loop fasteners are utilized, however alternatively snaps, hooks, buttons or other mechanical devices for fasteners may be utilized, as well as adhesive materials.

The colors, textures, designs, shapes, and/sizes of the interchangeable attachments can vary, along with materials used to manufacture same. Gem stones can be added, reflective threads, material. A light source, such as LED or fiber optics or the like, may be incorporated within the design of the interchangeable attachments, which can be in communication with a power source via battery, which in turn is in communication with an on/off switch, or instead in communication with a motion sensor or light sensor.

An interchangeable attachment for an article is provided wherein the article comprises a proximal end, distal end and a central section having at least one connection means appointed to receive an interchangeable attachment. The interchangeable attachment comprises a top wall having a show surface, side walls, and a back wall having a securing member adapted to engage with the connection means of the central section of the article for removably attaching the interchangeable attachment to the article. The article may comprise a hair accessory, including a head band or a barrette, or may include a belt, purse, clutch, pocketbook, handbag, backpack, a piece of clothing selected from the group consisting of a top, dress, or suspenders, or a baseball cap.

The show surface of the interchangeable attachment may include a gemstone, decorative glass or other decorative design piece attached thereto. In yet another embodiment, the interchangeable attachment includes an electroluminescent light (LED) or fiber optics integrated therein, both for decoration purposes as well as to provide safety. In cases where an electroluminescent lamp is provided, it is housed under the top wall of the interchangeable attachment, which is provided with transparent properties at the location of the light so that light is emitted. Preferably, the side walls of the interchangeable attachment include transparent portions for the emission of light. LED is attached to a battery housed within the interchangeable attachment. The LED and the optic light are used with a small watch battery, and last a long time (typically 200 hours or more), so battery life does not become a concern. The LED (or fiber optic light) may be turned on by initiating a power switch thereby closing a circuit. Or the LED may be turned on via motion sensor or by way of a light sensor so that the light is not turned on unless there is motion or it is dark out, thereby saving the battery life.

Alternatively, the show surface of the interchangeable attachment may include reflective properties. This has significant application when as applied to a child's back pack or bag in order to impart an added measure of safety to the wearer.

Preferably, reflectivity is provided by the incorporation of retroreflective corner cube reflectors or microsphere reflective elements thermally bonded and or stitched onto a strip that is bonded or stitched onto the top side of the interchangeable attachment to yield a reflective show surface. Preferably, reflectivity is provided via a plurality of glass reflective elements or beads bonded to the show surface so that the a large portion of light emitted from a light source is reflected such that the pathway for the angle of reflection of the light is substantially the same as the pathway for the angle of incidence. With this structure, the show surface reflects a significant quantum of the incident light from a car head light or other light emitting element back to the source. Reflectivity may be provided via corner cube prismatic or microsphere geometry bonded onto the show surface. These transparent retroreflective elements may be made from high refractive index transparent materials such as barium oxide-titanium oxide containing glasses. They exhibit a refractive index in the range of 1.9 to 2.2. Preferably, abrasion resistance properties are provided to the reflective show surface by applying a transparent coating onto the show surface of the interchangeable attachment. One such coating comprises a polymer that is transparent, flexible and has a refractive index significantly smaller than that of the retroreflective elements used. For example, thermosetting resin compositions such as two-component polyurethane may be painted or sprayed over the reflective show surface. Thermoplastic aliphatic thermoplastic polyurethanes are preferred as compared to aromatic urethanes because of their transparency, resistance to dirt build-up, flexibility ultraviolet radiation degradation resistance. Typically, aliphatic polyurethane has the structure $$[—O—(CH(CH_3)CH2O_{20}—C(O)—NH—R—NH—C(O)—]; \text{ or}$$

$$[—O—(CH_2—CH_2CH_2CH_2—O—)_{10}—C(O)—NH—R—NH—C(O)—],$$

where R is a non-aromatic group. The thickness of the transparent abrasion resistant coating is in the range of 0.002 to 0.010 inches. The coating has a refractive index significantly lesser than that of retroreflective elements bonded to the reflective strip bond to the show surface of the interchangeable attachment. Typically the retroreflective elements have a refractive index of 1.9 to 2.2 and the flexible transparent abrasion resistant polymeric coating has a refractive index of 1.3 to 1.55. A 0.002 to 0.010 inch layer of transparent flexible abrasion resistant polymeric coating does not affect the path of normally incident incoming light beam. With such a coating alteration of the path of inclined incident light beam is minimal. Similarly, the reflected light beam path is not severely affected. The internal reflection property of the retroreflective elements is not deteriorated since the abrasion resistant coating has significantly lower refractive index, as compared to that of the retroreflective elements.

Figure 1B:
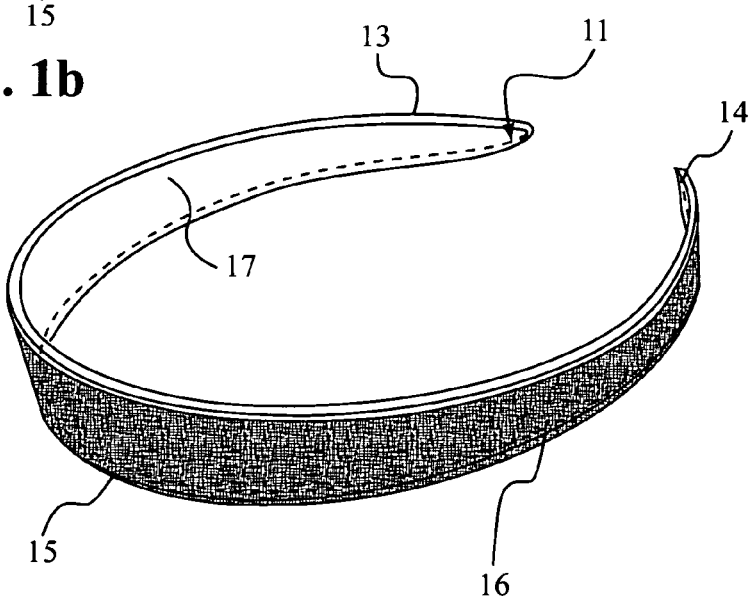
FIG. 1*b* is a schematic view of the embodiment of FIG. 1*a*, showing the headband detached from the interchangeable attachment.
Figure 1C:
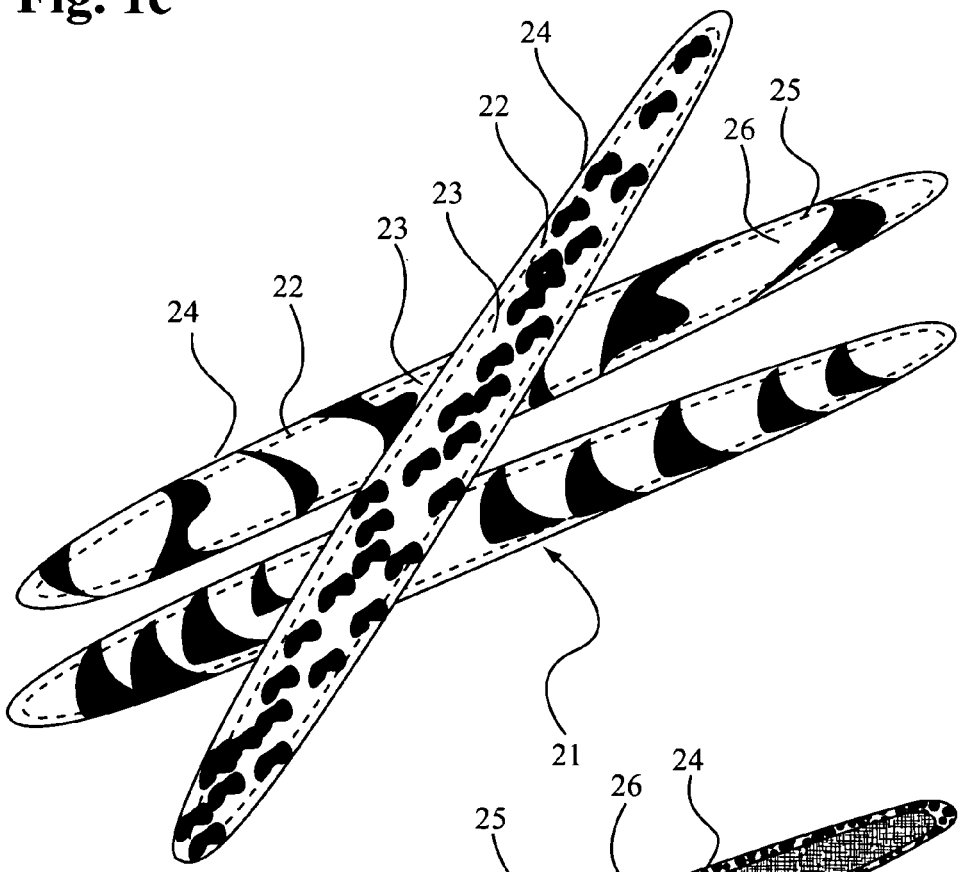
FIG. 1*c* is a schematic view of the embodiment of FIG. 1*a*, showing the top wall of the interchangeable attachments detached from the headband.
Figure 1D:
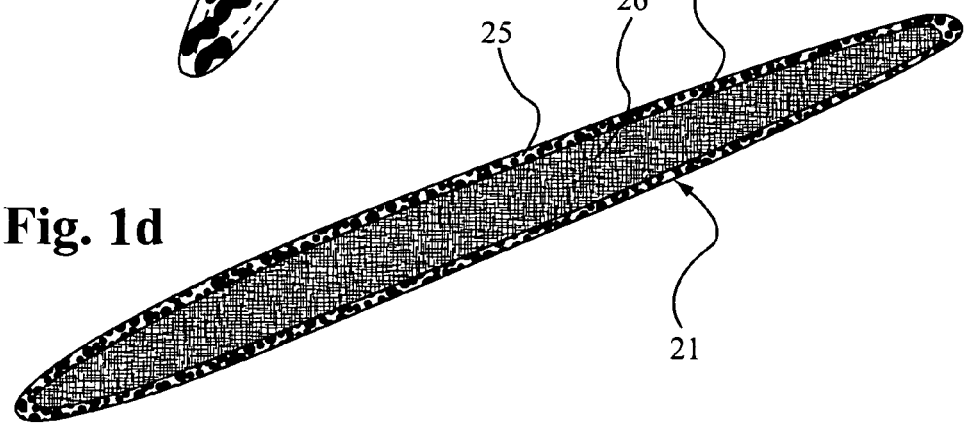
FIG. 1*d* is a schematic view of the embodiment of FIG. 1*a*, showing the bottom wall of the interchangeable attachments detached from the headband.

FIGS. 1*a*-1*d* show schematic views of a first embodiment of the interchangeable attachment for an article, wherein the article is provided as a head band and the interchangeable attachment is substantially covering the head band. Specifically, FIG. 1*a* shows the interchangeable attachment located on the head band, shown generally at 10; FIG. 1*b* shows the headband detached from the interchangeable attachment; FIG. 1*c* shows the top wall of interchangeable attachments detached from the headband; and FIG. 1*d* shows the bottom wall of the interchangeable attachments detached from the headband. The article herein is shown as a head band; however, the article can be a barrette, belt, purse, bag or backpack, or luggage. In the embodiment shown in FIG. 1*a*, the article is a hair accessory in the form of a head band 11 having an interchangeable attachment 21 removably attached thereto. Head band 11 includes a proximal end 13, distal end 14 and a central section 15. The central section 15 has at least one connection means 16 appointed to receive the interchangeable attachment 21. The interchangeable attachment 21 comprises a top wall 22 having a show surface 23, side walls 24, and a back wall 25 having a securing member 26 adapted to engage with the connection means 16 of the central section 15 of the head band 11. Preferably, head band 11 is constructed as an inner band portion 17 having an arced shaped configuration that is surrounded by a flexible sleeve having a top side and a bottom side, wherein the top side substantially includes the connection means 16 integrated therein appointed to receive the interchangeable attachment 21. As constructed, the interchangeable attachment 21 substantially covers head band 11. The flexible sleeve is preferably constructed of a flexible polymeric or latex material. The interchangeable attachment 21 fits over the hair band 11 and changes the look of the design, pattern, material, texture, etc. Preferably, connection means 16 and securing member 26 are constructed as mating hook and loop fasteners such as are sold under the trade name VELCRO. Alternatively, connection means 16 and securing member 26 may be constructed as mating magnetic portions (magnetic and metal, respectively) or having a low bonding adhesive integrated therein. A plurality of interchangeable attachments 21 may be provided having different patterns, designs, textures, jewels, beads, and/or LED or fiber optics may be integrated therein. Wherein LED or fiber optics are integrated therein, a small battery is provided integrated into the interchangeable attachments 21, which is in communication with an on/off power control. The power control can be in the form of an on/off push button, or more preferably, is provided as a motion sensor or light sensor integrated within interchangeable attachments 21.

Figure 2A:
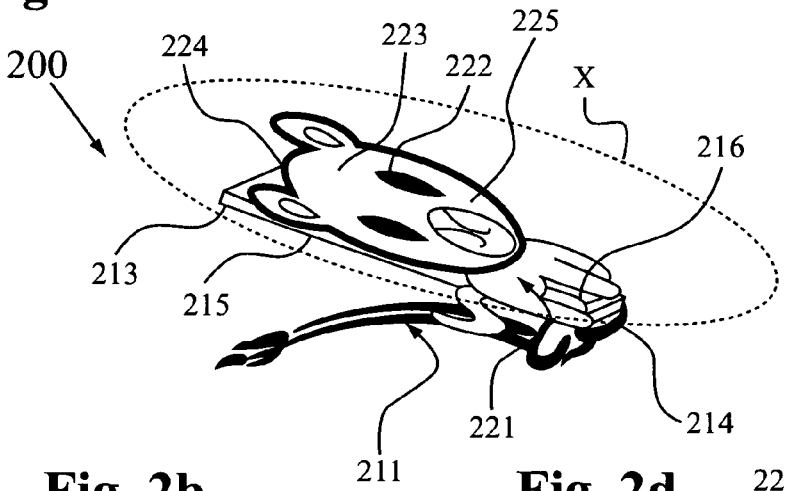
FIG. 2*a* is a schematic view of an embodiment of the interchangeable attachment for an article, wherein the article is provided as a barrette and the interchangeable attachment substantially covers the barrette.
Figure 2B:
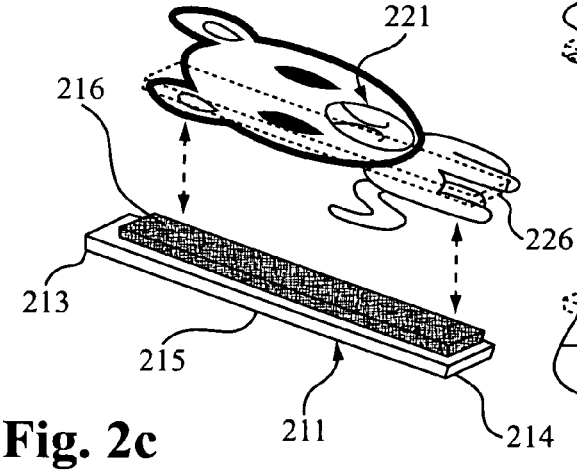
FIG. 2*b* is a schematic view of the embodiment of FIG. 2*a*, showing the barrette detached from the interchangeable attachment.
Figure 2D:
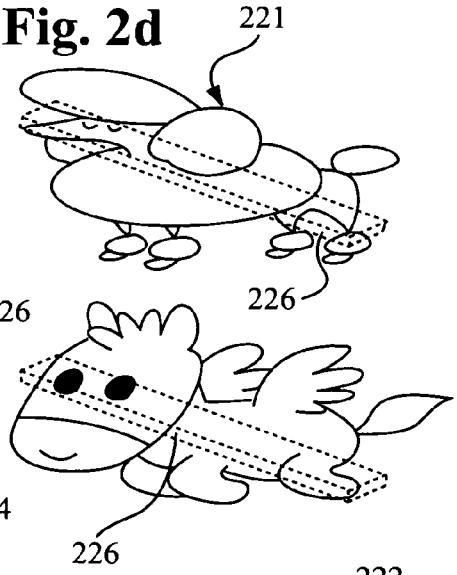
FIG. 2*d* is a schematic view of the embodiment of FIG. 2*a*, showing an example of the differently shaped interchangeable attachments.
Figure 2C:
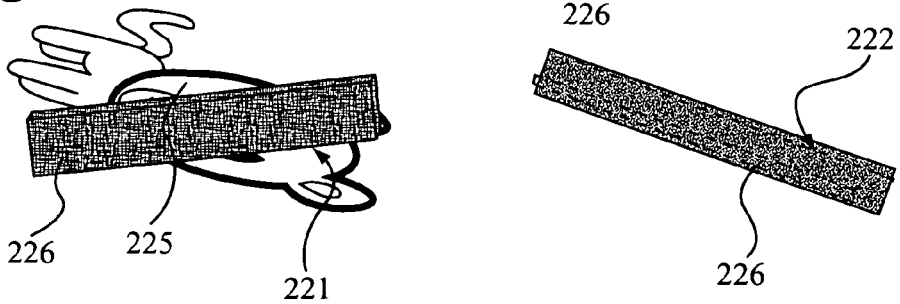
FIG. 2*c* is a schematic view of the embodiment of FIG. 2*a*, showing the bottom wall of the interchangeable attachment.

FIGS. 2*a*-2*d* illustrate views of another embodiment wherein the article is provided as a barrette. Specifically, FIG. 2*a* shows a barrette with the interchangeable attachment substantially covering the top of the barrette, shown generally at 200; FIG. 2*b* shows the barrette detached from the interchangeable attachment taken along cut-out X; FIG. 2*c* shows the bottom wall of the interchangeable attachment; and FIG. 2*d* shows an example of the differently shaped interchangeable attachments. In the embodiment shown in FIG. 2*a*, the article is a hair accessory in the form of a barrette 211 having an interchangeable attachment 221 removably attached thereto. Barrette 211 includes a proximal end 213, distal end 214 and a central section 215 having at least one connection means 216 appointed to receive the interchangeable attachment 221. The interchangeable attachment 221 comprises a top wall 222 having a show surface 223, side walls 224, and a back wall 225 having a securing member 226 adapted to engage with the connection means 216. Preferably, connection means 216 and securing member 226 are constructed as mating hook and loop fasteners such as that sold under the trade name VELCRO. Alternatively, connection means 216 and securing member 226 may be constructed as mating magnetic portions (magnetic and metal, respectively), or having a low bonding adhesive integrated therein. A plurality of interchangeable attachments 221 may be provided having different shapes, patterns, designs, textures, jewels, beads, and/or LED or fiber optics may be integrated therein. Wherein LED or fiber optics are integrated therein, a small battery is provided integrated into the body of the interchangeable attachments 221, which is in communication with an on/off power control. The power control can be in the form of an on/off button, or more preferably, is provided as a motion sensor or light sensor integrated within the interchangeable attachment 221.

Figure 3A:
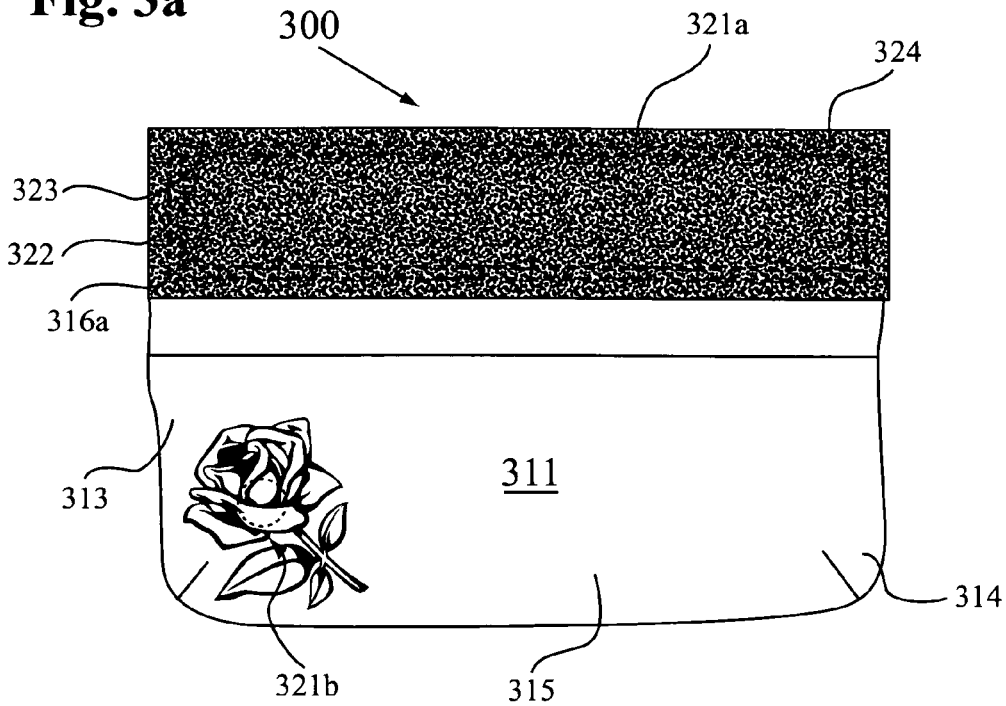
FIG. 3*a* is a schematic view of an embodiment of the interchangeable attachment for an article, wherein the article is provided as a clutch or hand bag and the interchangeable attachment is a section, and an optional supplemental interchangeable attachment is provided.
Figure 3B:
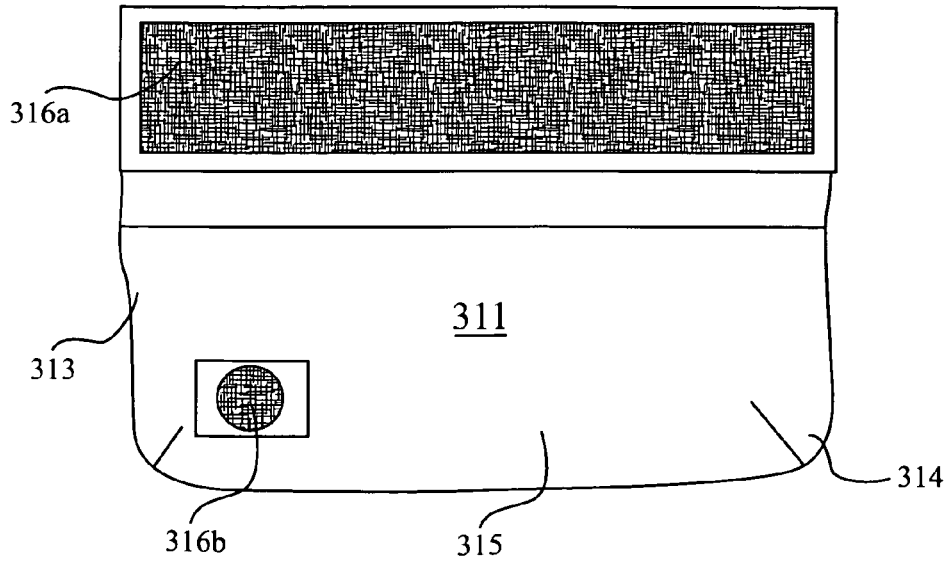
FIG. 3*b* is a schematic view of the embodiment of FIG. 3*a*, showing the clutch detached from the interchangeable attachments.
Figure 3C:
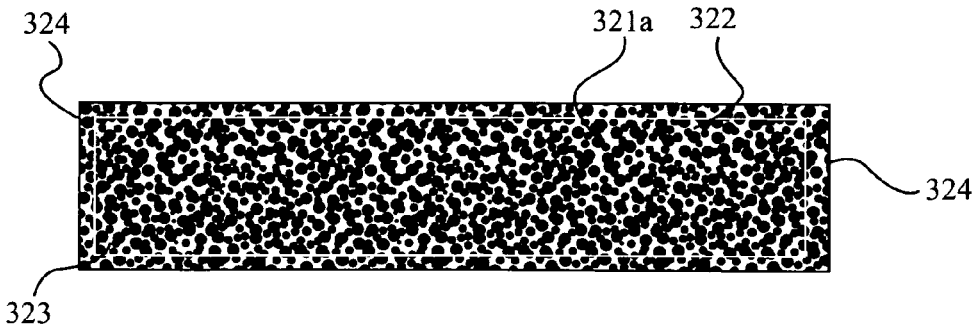
FIG. 3*c* is a schematic view of the embodiment of FIG. 3*a*, showing the top wall of the interchangeable attachment.
Figure 3D:
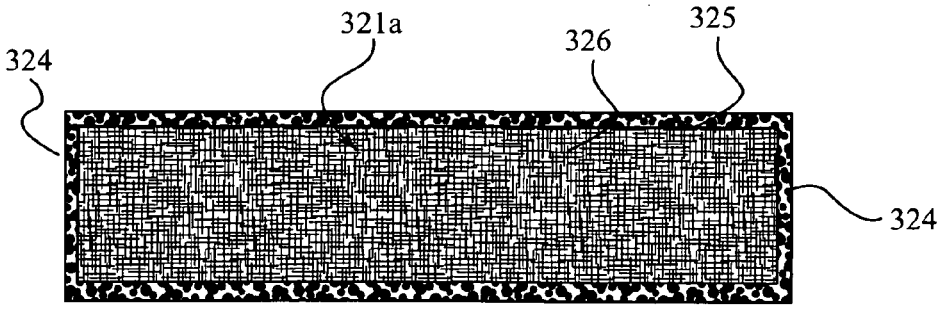
FIG. 3*d* is a schematic view of the embodiment of FIG. 3*a*, showing the bottom wall of the interchangeable attachment.
Figure 3E:
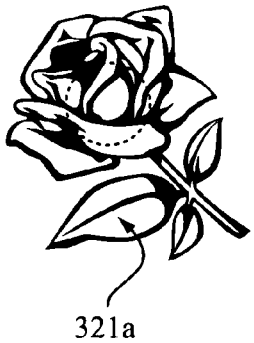
FIG. 3*e* is a schematic view of the embodiment of FIG. 3*a*, showing the top wall of the supplemental interchangeable attachment.
Figure 3F:
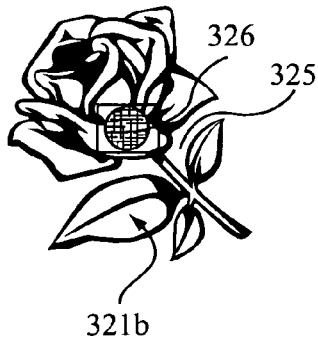
FIG. 3*f* is a schematic view of the embodiment of FIG. 3*a*, showing the bottom wall of the supplemental interchangeable attachment.

FIGS. 3*a*-3*f* illustrated another embodiment of the invention wherein the article is provided as a clutch, purse or handbag. FIG. 1*a* shows a clutch or hand bag with an interchangeable attachment constructed as an section and an optional supplemental interchangeable attachment shown as a flower design attached thereto, shown generally at 300; FIG. 3*b* shows the clutch detached from the interchangeable attachments; FIG. 3*c* shows the top wall of the interchangeable attachment; FIG. 3*d* shows the bottom wall of the interchangeable attachment; FIG. 3*e* shows the top wall of the supplemental interchangeable attachment; and FIG. 3*f* shows the bottom wall of the supplemental interchangeable attachment. Clutch 311 is shown having an interchangeable attachment 321*a* removably attached thereto. An optional supplemental interchangeable attachment 321*b* is also attached to clutch 311. Clutch 311 includes a proximal end 313, distal end 314 and a central section 315 having at least one connection means 316 appointed to receive the interchangeable attachment 321*a*. The interchangeable attachment 321*a* comprises a top wall 322 having a show surface 323, side walls 324, and a back wall 325 having a securing member 326 adapted to engage with the connection means 316. Preferably, connection means 316, 316*a* and securing member 326 are constructed as mating hook and loop fasteners such as that sold under the trade name VELCRO. Alternatively, connection means 316, 316*a* and securing member 326 may be constructed as mating magnetic portions (magnetic and metal, respectively), or having a low bonding adhesive/stitching integrated therein. A plurality of interchangeable attachments 321 may be provided having different shapes, patterns, designs, textures, jewels, beads, and/or LED or fiber optics may be integrated therein. Wherein LED or fiber optics are integrated therein, a small battery is provided integrated into the body of the interchangeable attachments 321, which is in communication with an on/off power control. The power control can be in the form of an on/off push button or switch, or more preferably, is provided as a motion sensor or light sensor integrated within the interchangeable attachment 321. In the embodiment shown, a supplementary connection means 351 is provided located on the proximal end 313 of clutch 311 which is appointed to receive a supplemental interchangeable attachment 321*b* shown as a flower.

The connection means 316 is preferably hook and loop fasteners that are sewn on to the clutch 311. The interchangeable attachment 321 is provided as a separate appliqué, patch, or overlay that is placed on the clutch 311. The interchangeable attachment 321 overlay can be designed with jewelry, a variety of gem stones, crystals, beads, etc. an wide variety of various kinds of material, such as corduroy, suede, patterned or not, textured, etc. The interchangeable attachment 321 allows the ability to change the look of a day bag to an evening bag/an evening bag to a day bag with just a "swap" of an appliqué, patch/interchangeable attachment 321. Preferably, the interchangeable attachments 321, 321*a*, 321*b* are sold as secondary items and can be selected according to design and taste of consumer. Alternatively, a plurality of interchangeable attachments 321, 321*a*, and 321*b* can be provided in different shapes and designs as an overlay kit, so that a consumer can design her own individual piece.

Figure 4A:
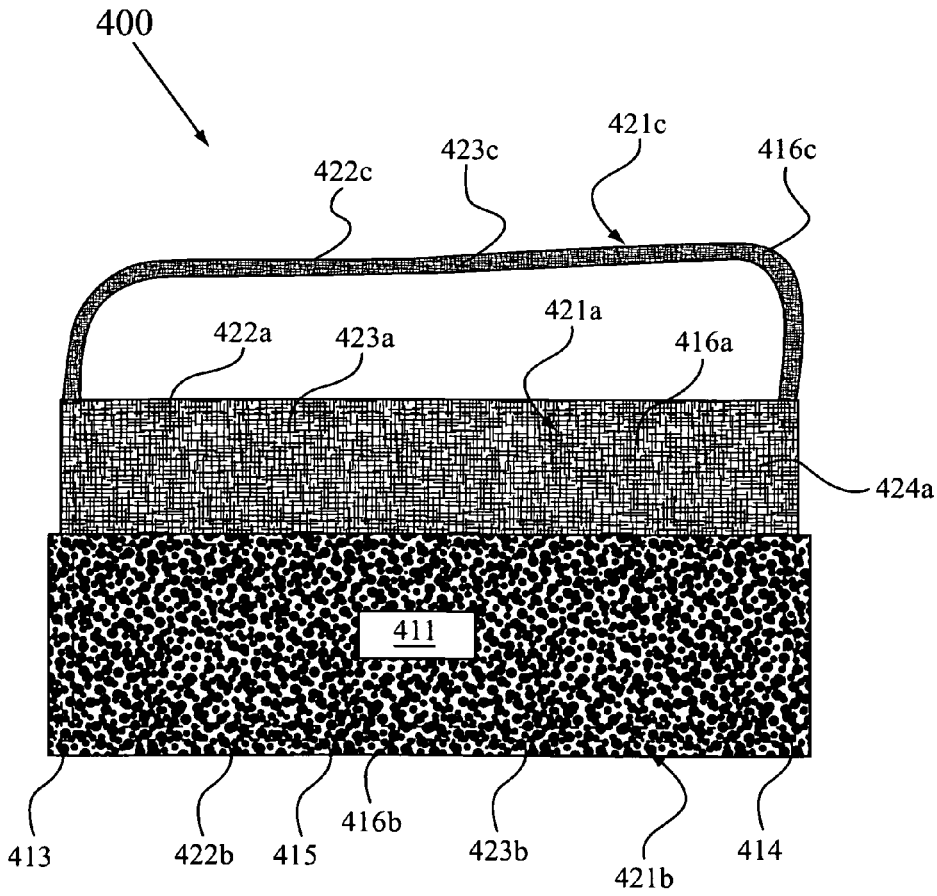
FIG. 4*a* is a schematic view of an embodiment of the interchangeable attachment for an article, wherein the article is provided as a clutch and three interchangeable attachments are provided as sections, located on the top of the bag, middle and strap.
Figure 4B:
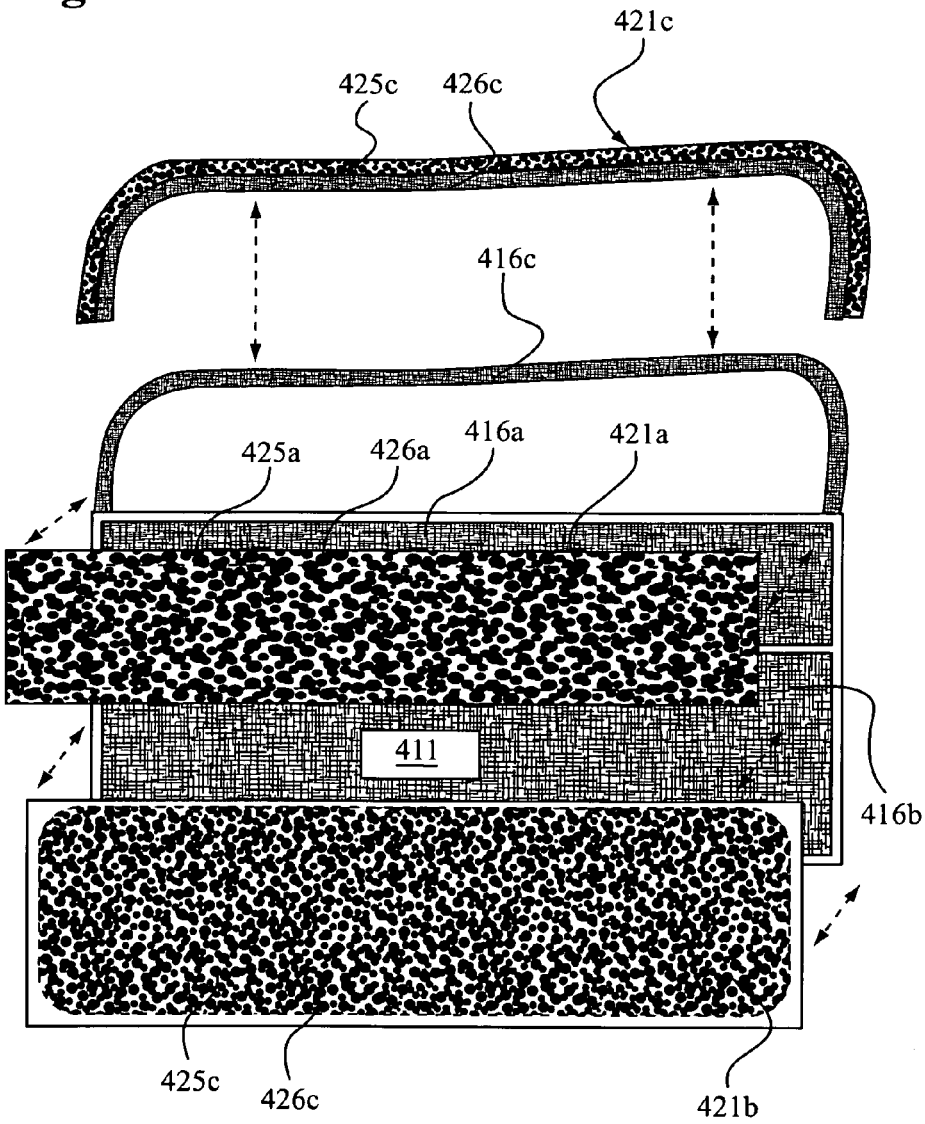
FIG. 4*b* is a schematic view of the embodiment of FIG. 4*a*, showing each of the interchangeable attachments being placed onto the clutch.
Figure 4C:
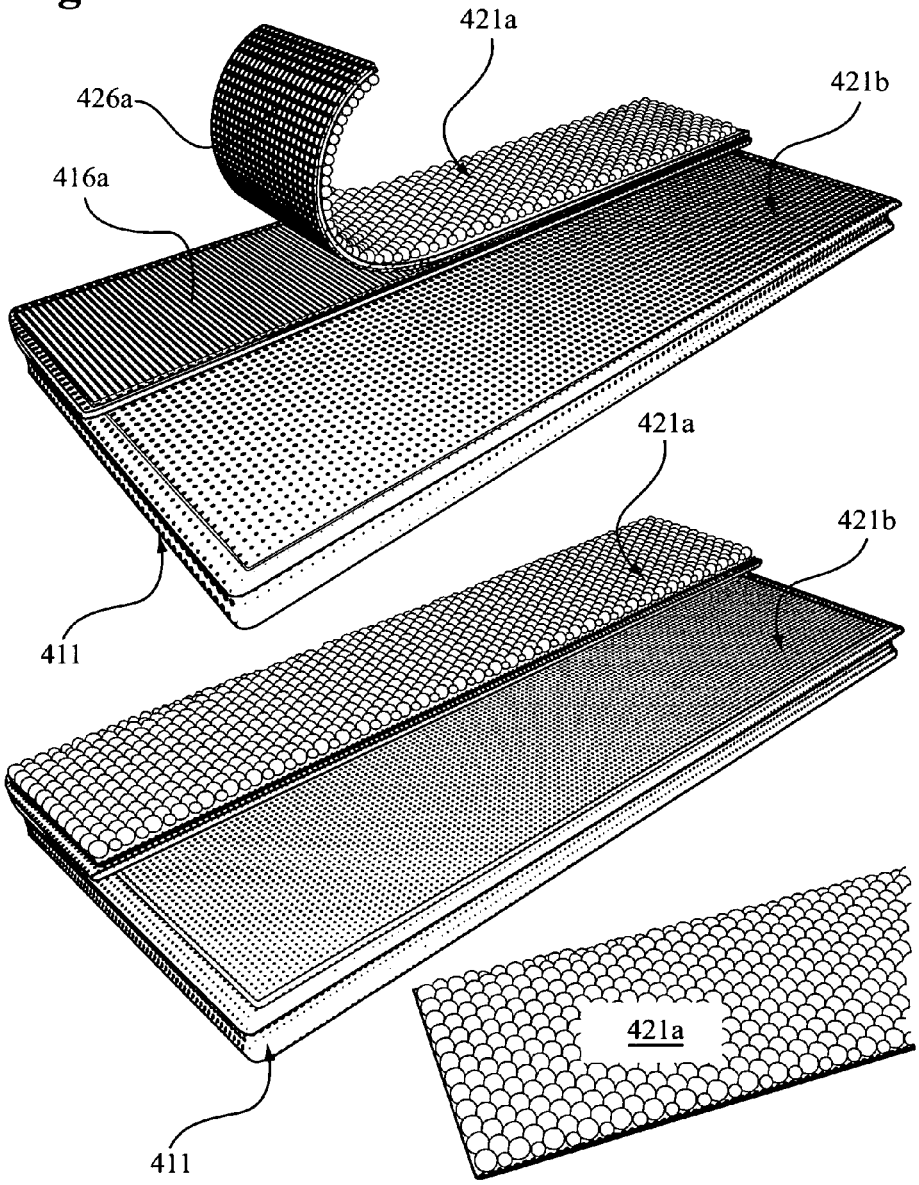
FIG. 4*c* is a schematic view of the embodiment of FIG. 4*a*, showing two of the interchangeable attachments being placed onto the clutch.
Figure 4D:
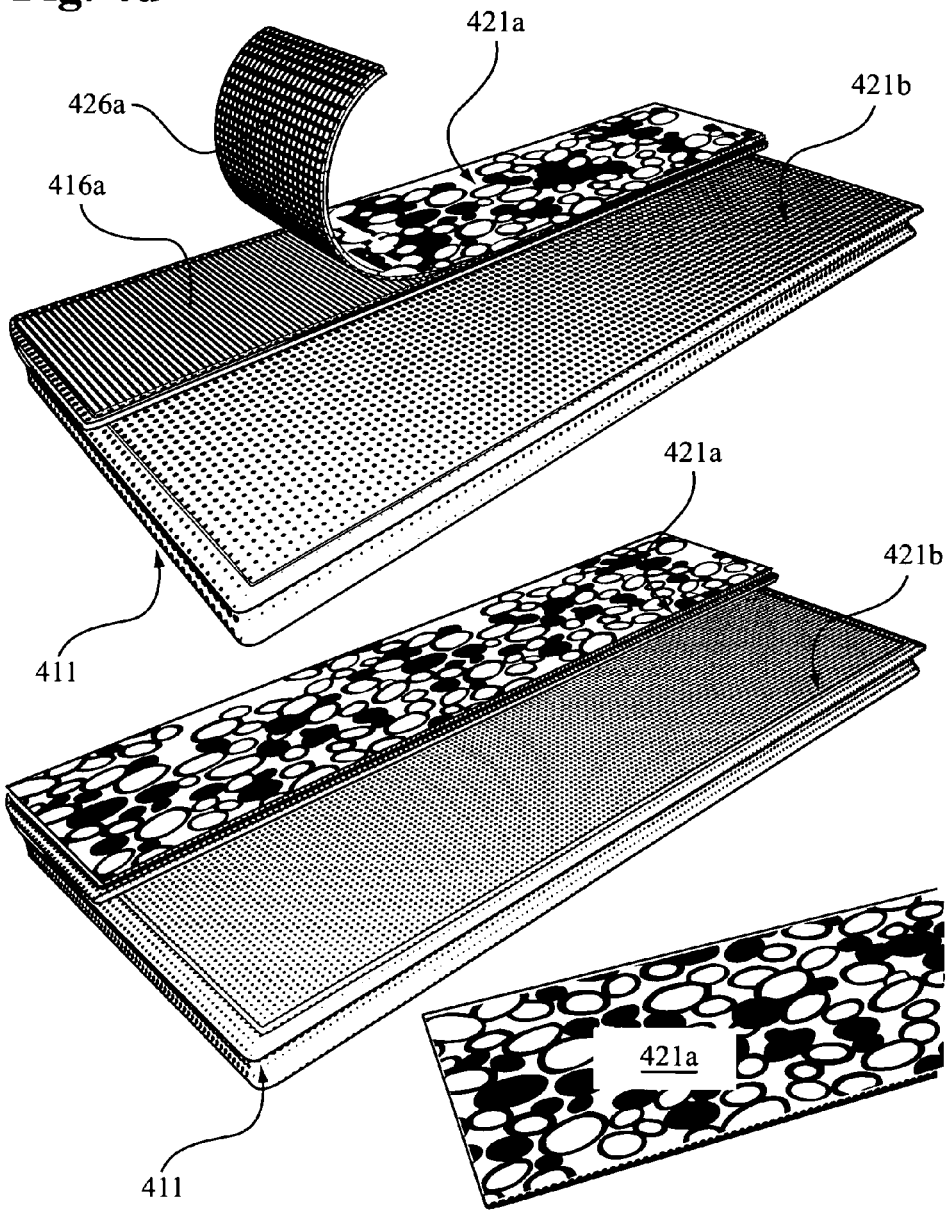
FIG. 4*d* is a schematic view of the embodiment of FIG. 4*a*, showing two other interchangeable attachments being placed onto the clutch.

FIGS. 4*a*-4*d* illustrate another embodiment of the invention wherein the article is provided as a clutch, purse or handbag, shown generally at 400. FIG. 4*a* shows a clutch 411 having three interchangeable attachments 421*a*, 421*b* and 421*c* provided as elongated sections, located on the top of the bag, middle and strap. FIG. 4*b* is a schematic view showing each of the interchangeable attachments 421*a*, 421*b* and 421*c* being placed onto the clutch 411. FIGS. 4*c* and 4*d* are schematic views showing two of the interchangeable attachments 421*a*, 421*b* being placed onto the clutch. Clutch 411 is shown having an interchangeable attachment 421*a*, 421*b* and 421*c* removably attached thereto. Clutch 411 includes a proximal end 413, distal end 414 and a central section 415 having connection means 416*a*, 416*b* and 416*c* appointed to receive the interchangeable attachments 421*a*, 421*b* and 421*c*. The interchangeable attachments 421*a*, 421*b* and 421*c* comprise a top wall 422 having a show surface 423, side walls 424, and a back wall 425 having a securing member 426 adapted to engage with the connection means 416*a*, 416*b* and 416*c*. Preferably, connection means 416*a*, 416*b* and 416*c* and securing member 426 are constructed as mating hook and loop fasteners such as that sold under the trade name VELCRO. Alternatively, connection means 416*a*, 416*b* and 416*c* and securing member 426 may be constructed as mating magnetic portions (magnetic and metal, respectively), or having a low bonding adhesive/stitching integrated therein.

Figure 5A:
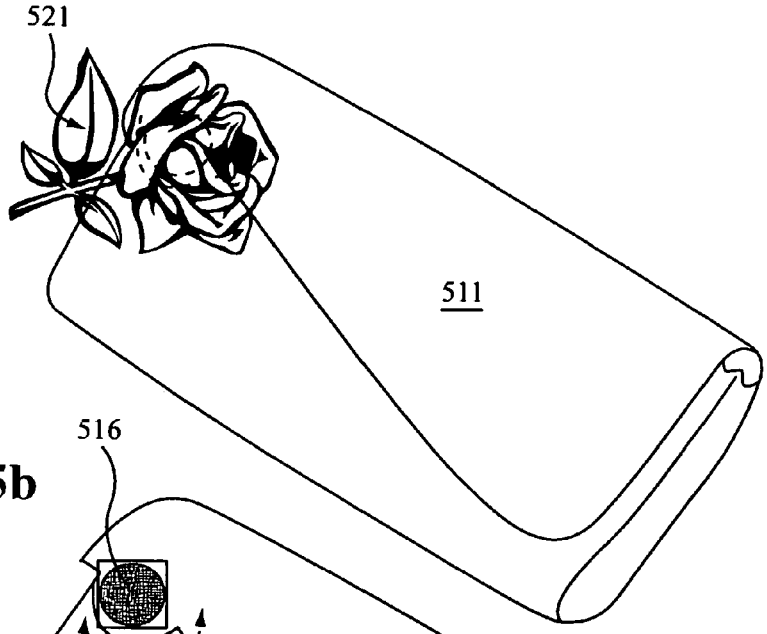
FIG. 5*a* is a schematic view of an embodiment of the interchangeable attachment for an article, wherein the article is provided as a clutch and an interchangeable attachment patch is attached thereto.
Figure 5B:
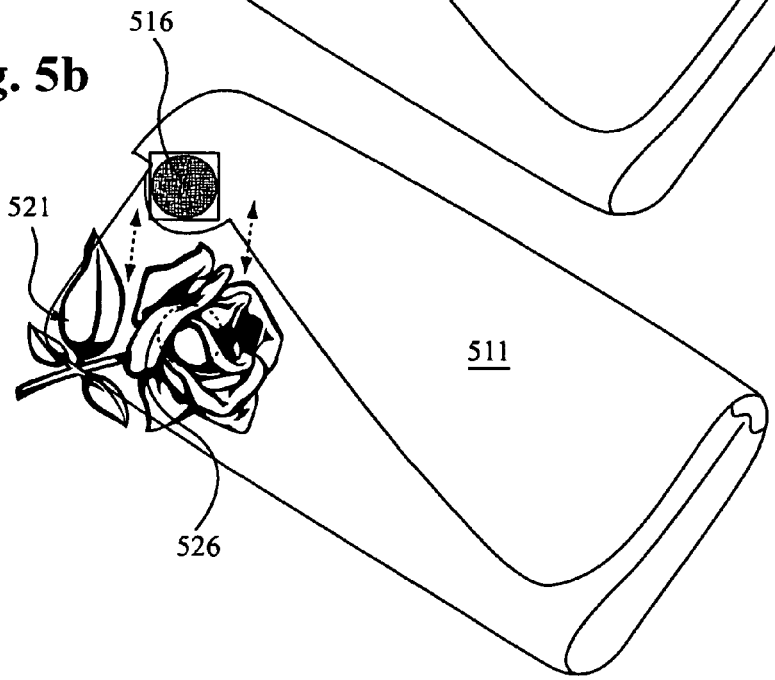
FIG. 5*b* is a schematic view of the embodiment of FIG. 5*a*, showing the interchangeable attachment being placed onto the clutch.

FIGS. 5*a* and 5*b* illustrate another embodiment wherein the article is provided as a clutch 511 and an interchangeable attachment patch 521 is attached thereto. Clutch 511 includes a connection means 516 appointed to receive the interchangeable attachment 521. The interchangeable attachment 521 comprises a securing member 526 adapted to engage with the connection means 516.

Figure 6:
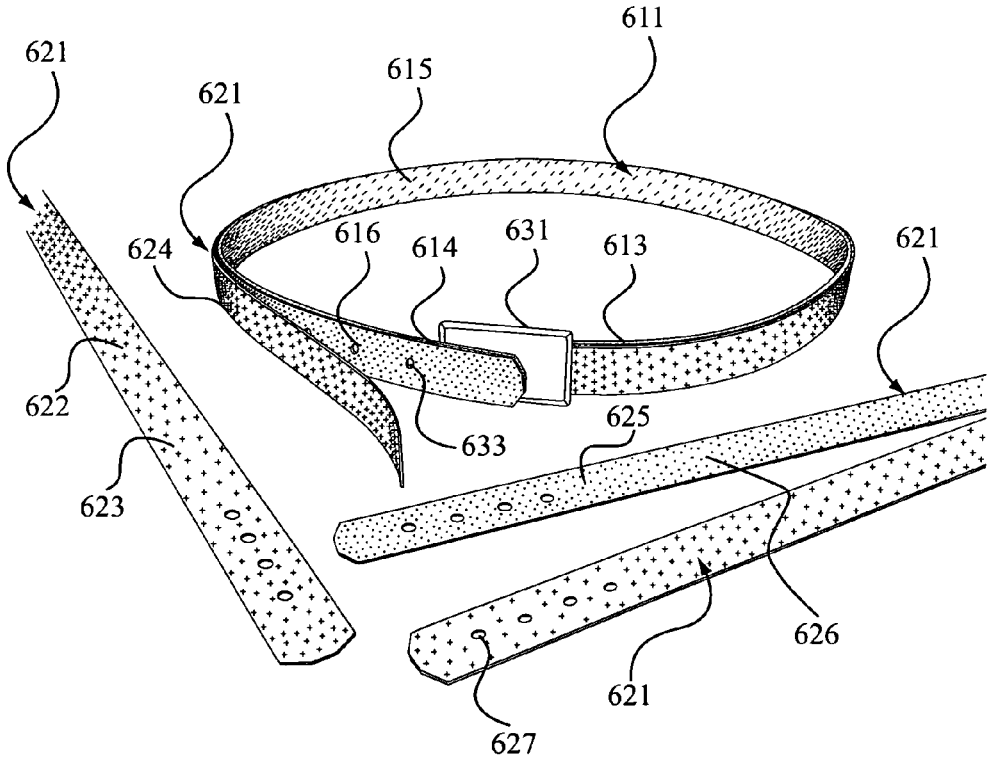
FIG. 6 is a schematic view of an embodiment of the interchangeable attachment for an article, wherein the article is provided as a belt.

FIG. 6 is a schematic view of an embodiment of the interchangeable attachment for an article, wherein the article is provided as belt. The belt 611 is designed with hook and loop material (VELCRO™), whereby the belt (with buckle, snap) 611 receives the interchangeable attachment 621 designed specifically to lay flat on the top side of belt 611, thereby changing the entire look of the item, changing the pattern, material, texture, etc., by just adding the interchangeable attachment 621 as an overlay application. Belt 611 includes a proximal end 613, distal end 614 and a central section 615 having connection means 616 appointed to receive the interchangeable attachment 621. The interchangeable attachment 621 comprises a top wall 622 having a show surface 623, side walls 624, and a back wall 625 having a securing member 626 adapted to engage with the connection means 616. In an embodiment where the belt 611 includes a buckle 631 and belt holes 633, the interchangeable attachment 621 includes correspondingly aligned holes 627.

Figure 7A:
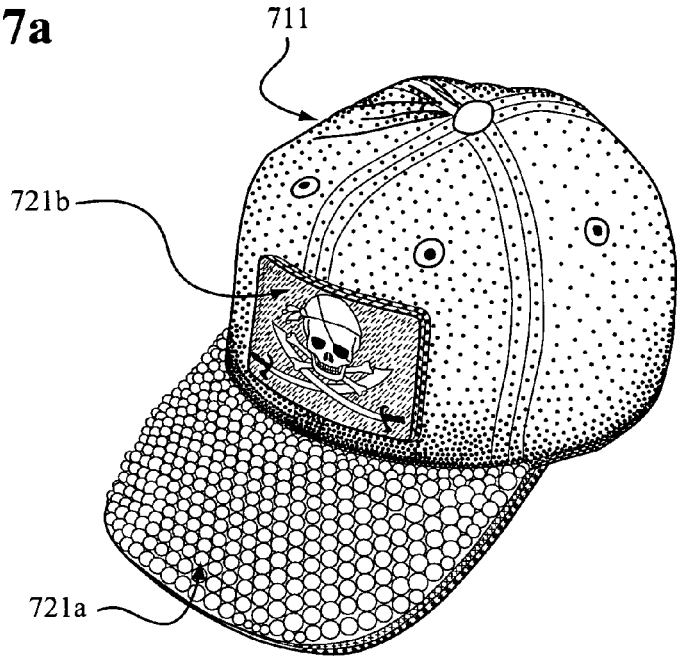
FIG. 7*a* is a schematic view of an embodiment of the interchangeable attachment for an article, wherein the article is provided as a baseball cap and an interchangeable attachment is attached thereto.
Figure 7B:
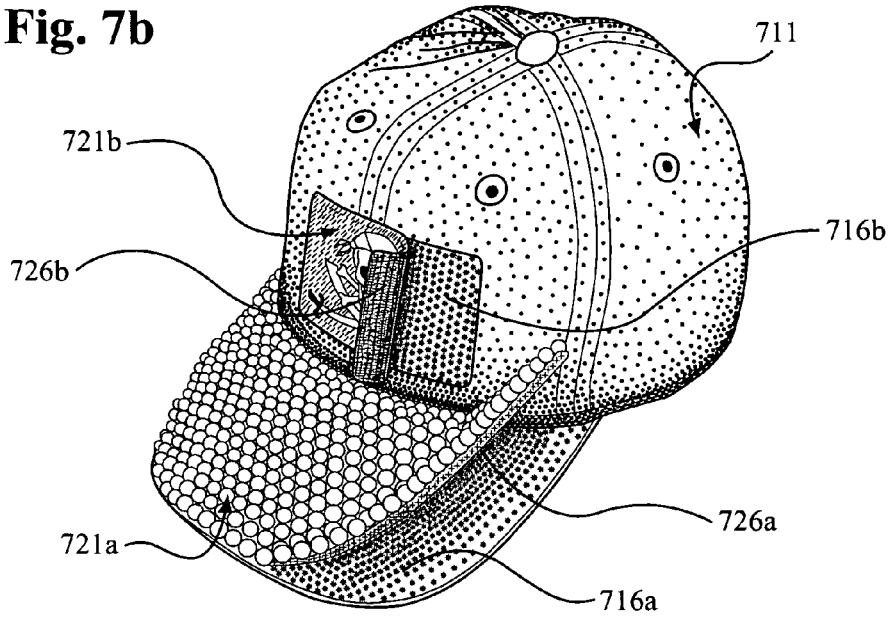
FIG. 7*b* is a cross-sectional view of the embodiment of FIG. 7*a;*

FIG. 7*a* is a schematic view of an embodiment of the interchangeable attachment for an article, wherein the article is provided as a baseball cap and an interchangeable attachment is attached thereto. FIG. 7*b* is a view of the embodiment of FIG. 7*a* with the interchangeable attachments being placed/removed from the cap. In this embodiment, the article is provided as a hat or baseball cap 711. Baseball cap 711 includes a connection means 716*a* appointed to receive an interchangeable attachment 721*a* formed as a brim overlay. Alternatively, a second connection means 716*b* is provided for receiving a second interchangeable attachment 721*b* (shaped as an appliqué/patch, or swatch overlay), herein shown as a logo or sports team swatch, located on the lid portion of the baseball cap 711. The interchangeable attachment 721*a*, 721*b* comprises a securing member 726*a*, 726*b* adapted to engage with the connection means 716*a*, 716*b*. Baseball hat 711 is able change the look of the brim by placing the brim overlay interchangeable attachment 721*a* onto the brim, taking the typical baseball hat, and transforming it into something more glamorous or something where a message is delivered. Preferably, connection means 716*a*, 716*b* and securing member 726*a*, 726*b* are constructed as mating hook and loop fasteners such as that sold under the trade name VELCRO. The interchangeable attachments 721*a*, 721*b* can be provided as appliqué or patch overlays, in a variety of shapes, and can be designed for males and/or females. The interchangeable attachments 721*a*, 721*b* are made of varying materials and textures, including beads, crystals, gem stones, reflective material and are appointed with the securing member 726*a*, 726*b* attached thereto preferably via sewing or bonding with adhesive. The interchangeable attachments 721*a*, 721*b* are designed uniquely, and fashionably to enhance any existing product, be it by adding more sophistication, or by adding more fun. For the hat, the brim interchangeable attachment 721*a* may, for example, be designed with a beaded or sparkling overlay, making a visible difference. Although the interchangeable attachments 721*a*, 721*b* are shown on the brim and front lid area of the baseball cap 711, the interchangeable attachments 721*a*, 721*b* may be provided to be placed anywhere on the baseball cap 711. Ultimately a fabric, hook and loop material, or the like, can make up and comprise the entire exterior surface of the baseball cap 711, whereby a person is capable of designing the entire cap 711 with interchangeable attachments appliqué patches. In conjunction, a kit of interchangeable attachments may be offered via a variety of different shapes, textures and designs, or a plurality of interchangeable attachments may be provided along with adhesive backed connection mean sections wherein the ability to cut and create individual shapes if provided, from which the user can then attach cut-out connection mean sections to the item and place the corresponding cut-out interchangeable attachment shape and design onto an existing hat, or any other item. In this embodiment, both the securing means for the interchangeable attachments and connection means sections comprise hook and loop fasteners strips or pieces, such as those sold under the trade name VELCRO.

Figure 8:
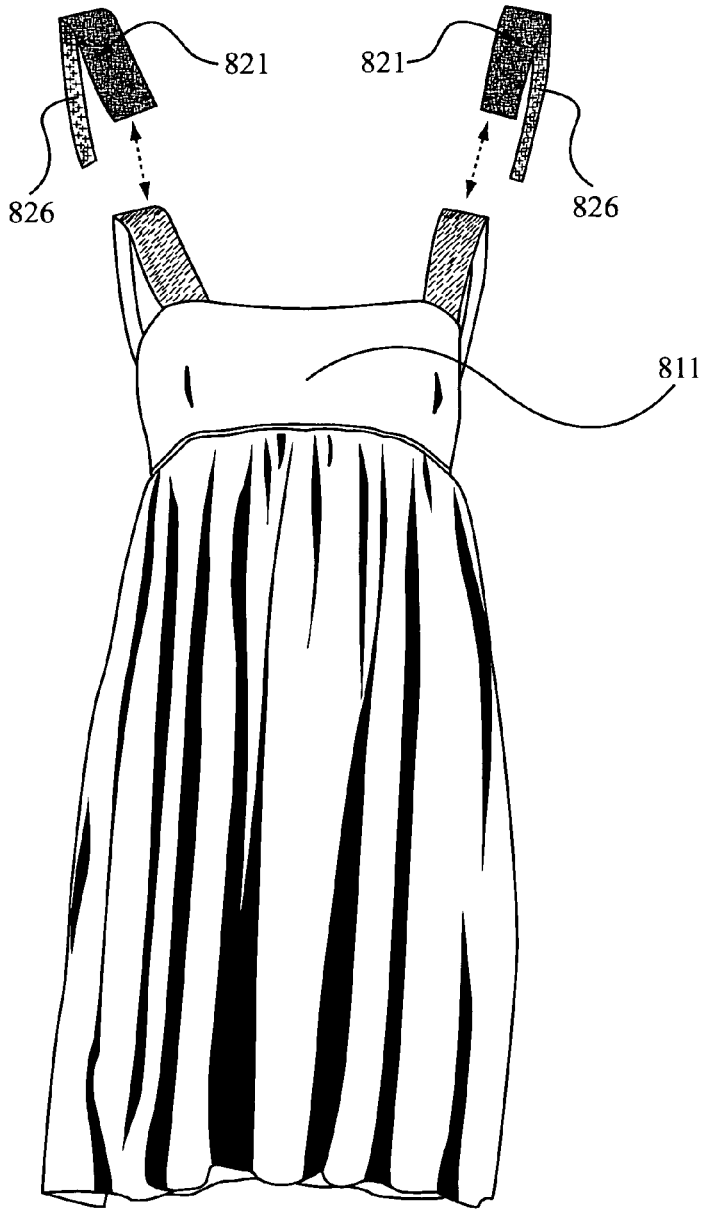
FIG. 8 is a schematic view of an embodiment of the interchangeable attachment for an article, wherein the article is provided as a dress or strap top and interchangeable attachments are appointed to be attached thereto.

FIG. 8 is a schematic view of an embodiment of the interchangeable attachment for an article, wherein the article is provided as a dress or strap top and interchangeable attachments are appointed to be attached thereto. Dress 811 includes a connection means 816 appointed to receive an interchangeable attachment 821. Herein, interchangeable attachment 821 is preferably provided as straps so that the look of the dress can be readily changed depending on the strap selected. The interchangeable attachment 821 comprises a securing member 826 adapted to engage with the connection means 816. The dress may instead be a tank top or suspenders wherein straps are implemented in the construct of the clothing. Preferably, connection means 816 and securing member 826 are constructed as mating hook and loop fasteners such as that sold under the trade name VELCRO.

Figure 9A:
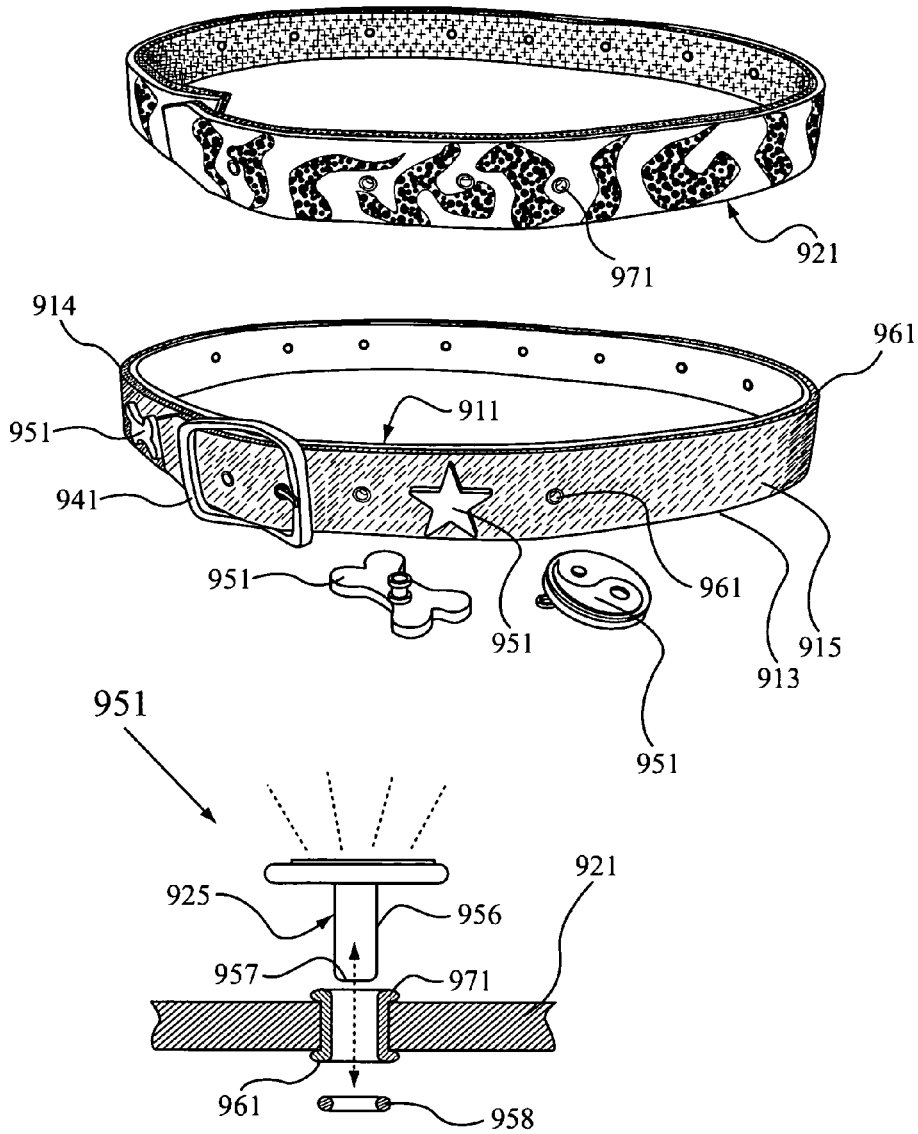
FIG. 9*a* is a schematic view of an embodiment of the interchangeable attachment for an article, wherein the article is provided as a belt and an interchangeable attachment patch is attached thereto along with a plurality of secondary interchangeable button-type attachments.
Figure 9B:
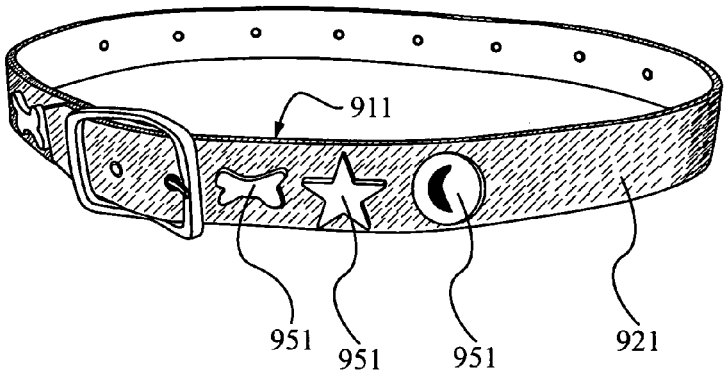
FIG. 9*b* is a schematic view of the embodiment of FIG. 9*a*, showing the final belt with the interchangeable attachments attached thereto.

FIG. 9*a* is a schematic view of an embodiment of the interchangeable attachment for an article, wherein the article is provided as a belt 911 and an interchangeable attachment 921 is attached thereto along with a plurality of secondary interchangeable button-type attachments 951. FIG. 9*b* is a schematic view of the embodiment of FIG. 9*a*, showing the final belt 911 with the interchangeable attachments 921, 951 attached thereto. Belt 911 is provided with a plurality of interchangeable attachments 921, 951 added-on to the articles. Belt 911 includes an elongated region comprising a proximal end 913, distal end 914 and a central section 915 having a connection means 916 appointed to receive an interchangeable attachment 921. Proximal end 913 includes a buckle 941. The central section 915 has at least one connection means 916 appointed to receive elongated interchangeable attachment 921. A plurality of holes 961 are integrated in said central portion 915 of said belt 911 and corresponding plurality of holes 971 are integrated in said interchangeable attachment 921. At least one secondary interchangeable attachment 951 or decorative attachment is provided that is appointed to be received within said holes 961, 971. Secondary interchangeable attachment 951 is constructed having a securing member 925 comprising a shaft portion 956 with a shaft end 957. Shaft portion 956 is received and housed within the hoes 961, 971 so that the secondary interchangeable attachment 951 is removably attached to belt 911. A locking cap 958 may be provided that is appointed to receive shaft end 957 of the shaft portion 956. Alternatively, securing member 925 of the interchangeable attachment 951 comprises a shaft portion 956 with a shaft end 957 formed as a bulbous portion (not shown) having a bulbous diameter slightly greater than the holes 961, 971 diameter. For ease of insertion into holes 961, 971, preferably the bulbous portion of the interchangeable attachment 951 is composed of a flexible or deformable material.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. An interchangeable attachment for a head band, wherein:

a. said head band having a proximal end, distal end and a central section;

b. said central section of said head band having at least one connection means appointed to receive said interchangeable attachment;

c. said interchangeable attachment comprising a top wall having a show surface, side walls, and a back wall having a securing member adapted to engage with said connection means of said central section of said head band for removably attaching said interchangeable attachment to said head band; and d. said head band comprising an inner band portion surrounded by a flexible sleeve having. a top side and a bottom side, wherein said top side of said flexible sleeve substantially includes said connection means integrated therein appointed to receive said interchangeable attachment, so that said interchangeable attachment substantially covers said top side of side flexible sleeve and vis à vis substantially covers said head band.

2. An interchangeable attachment for a head band as recited by claim 1, wherein said show surface of said interchangeable attachment includes reflective properties.

3. An interchangeable attachment for a head band as recited by claim 1, wherein said show surface of said interchangeable attachment includes an electroluminescent light integrated therein.

4. An interchangeable attachment for a head band as recited by claim 1, wherein at least a portion of each of said securing member and said connection means of said interchangeable attachment and said central section of said head band, respectively, include mating hook and loop fasteners.

5. An interchangeable attachment for a head band as recited by claim 1, wherein said connection means of said central section comprises a plurality of secondary connection patches appointed to receive a plurality of said interchangeable attachments.

6. An interchangeable attachment for a head band as recited by claim 1, wherein an interchangeable attachment kit is provided comprising a plurality of said interchangeable attachments each having varying show surfaces.

7. An interchangeable attachment for a head band as recited by claim 1, wherein said interchangeable attachment is an elongated attachment portion adapted to substantially cover said central section of said head band.

8. An interchangeable attachment for a head band as recited by claim 1, wherein said interchangeable attachment is provided as a patch.

9. An interchangeable attachment for a head band as recited by claim 1 comprising a plurality of holes integrated in said central portion of said head band and corresponding plurality of holes integrated in said interchangeable attachment, and wherein at least one secondary interchangeable attachment or decorative attachment is provided that is appointed to be receive within said holes.

10. An interchangeable attachment for an article, wherein:

a. said article has a proximal end, distal end and a central section;

b. said central section of said article has at least one connection means appointed to receive said interchangeable attachment;

c. said interchangeable attachment comprises a top wall having a show surface, side walls, and a back wall having a securing member adapted to engage with said connection means of said central section of said article for removably attaching said interchangeable attachment to said article;

d. said article is selected from the group consisting of a purse, clutch, pocketbook and handbag; and e. said article further includes supplementary connection means located on said proximal end and distal end of said article appointed to receive a plurality of said interchangeable attachments.

11. An interchangeable attachment for an article as recited by claim 10, wherein said show surface of said interchangeable attachment includes reflective properties.

12. An interchangeable attachment for an article as recited by claim 10, wherein said show surface of said interchangeable attachment includes an electroluminescent light integrated therein.

13. An interchangeable attachment for an article as recited by claim 10, wherein at least a portion of each of said securing member and said connection means of said interchangeable attachment and said central section of said article, respectively, include mating hook and loop fasteners.

14. An interchangeable attachment for an article as recited by claim 10, wherein at least a portion of each of said securing member and said connection means of said interchangeable attachment and said central section of said article, respectively, include mating magnetic fasteners.

15. An interchangeable attachment for an article as recited by claim 10, wherein said connection means of said central section comprises a plurality of secondary connection patches appointed to receive a plurality of said interchangeable attachments.

16. An interchangeable attachment for an article as recited by claim 10, wherein said interchangeable attachment is an elongated attachment portion adapted to substantially cover said central section of said article.

17. An interchangeable attachment for an article as recited by claim 10 comprising a plurality of holes integrated in said central portion of said article and corresponding plurality of holes integrated in said interchangeable attachment, and wherein at least one secondary interchangeable attachment or decorative attachment is provided that is appointed to be receive within said holes.

18. An interchangeable attachment for an article as recited by claim 10, wherein an interchangeable attachment kit is provided comprising a plurality of said interchangeable attachments each having varying show surfaces.

19. An interchangeable attachment for an article as recited by claim 10, wherein said interchangeable attachment is provided as a patch.

20. An interchangeable attachment for an article, wherein:

a. said article has a proximal end, distal end and a central section;

b. said central section of said article has at least one connection means appointed to receive said interchangeable attachment;

c. said interchangeable attachment comprises a top wall having a show surface, side walls, and a back wall having a securing member adapted to engage with said connection means of said central section of said article for removably attaching said interchangeable attachment to said article; and d. said article further includes supplementary connection means located on said proximal end and distal end of said article appointed to receive a plurality of said interchangeable attachments.

21. An interchangeable attachment for an article as recited by claim 20, wherein said article is a hair accessory.

22. An interchangeable attachment for an article as recited by claim 20, wherein said article is a belt.

23. An interchangeable attachment for an article as recited by claim 20, wherein said article is a backpack.

24. An interchangeable attachment for an article as recited by claim 20, wherein said article is a piece of clothing selected from the group consisting of a top, dress, or suspenders.

25. An interchangeable attachment for an article as recited by claim 20, wherein said article is a baseball cap.

* * * * *